US006693560B2

(12) United States Patent
Knust et al.

(10) Patent No.: US 6,693,560 B2
(45) Date of Patent: Feb. 17, 2004

(54) SUBMARINE MAST AUTONOMOUS CONTROLLER AND METHOD

(75) Inventors: Howard E. Knust, Jewett City, CT (US); Kichul Cho, North Kingstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 2 days.

(21) Appl. No.: 10/090,989

(22) Filed: Mar. 4, 2002

(65) Prior Publication Data

US 2003/0164776 A1 Sep. 4, 2003

(51) Int. Cl.[7] ..... G08B 23/00
(52) U.S. Cl. ..... 340/984; 114/340
(58) Field of Search ..... 340/984; 114/340; 343/709

(56) References Cited

U.S. PATENT DOCUMENTS 4,300,468 A * 11/1981 Catano et al. ..... 114/340
4,771,721 A * 9/1988 Pratt ..... 114/340
5,126,978 A * 6/1992 Chaum ..... 367/135
5,977,918 A * 11/1999 Sirmalis ..... 343/709
6,280,228 B1 * 8/2001 Maciejewski et al. ..... 439/374

* cited by examiner

*Primary Examiner*—John Tweel
(74) *Attorney, Agent, or Firm*—James M. Kasischke; Michael F. Oglo; Jean-Paul A. Nasser

(57) ABSTRACT

A system and method provides automatic monitoring of data representing the onset of, or occurrence of fault conditions for a submarine mast system. The system is separately programmable and transparently operable with respect to the mast host system that controls mast functions. In a preferred embodiment, a plurality of sensors are in communication with a microprocessor system to record data by time and date of the event. The communication of data from the sensors to the microprocessor is electrically isolated from control signal communications to mast components, and the sensors are further individually opto-isolated. The microprocessor may selectively transfer data on a time-shared basis over host system communication lines to an independent memory collecting submarine fleet data, as an aid in fleet-wide maintenance decision making.

21 Claims, 1 Drawing Sheet

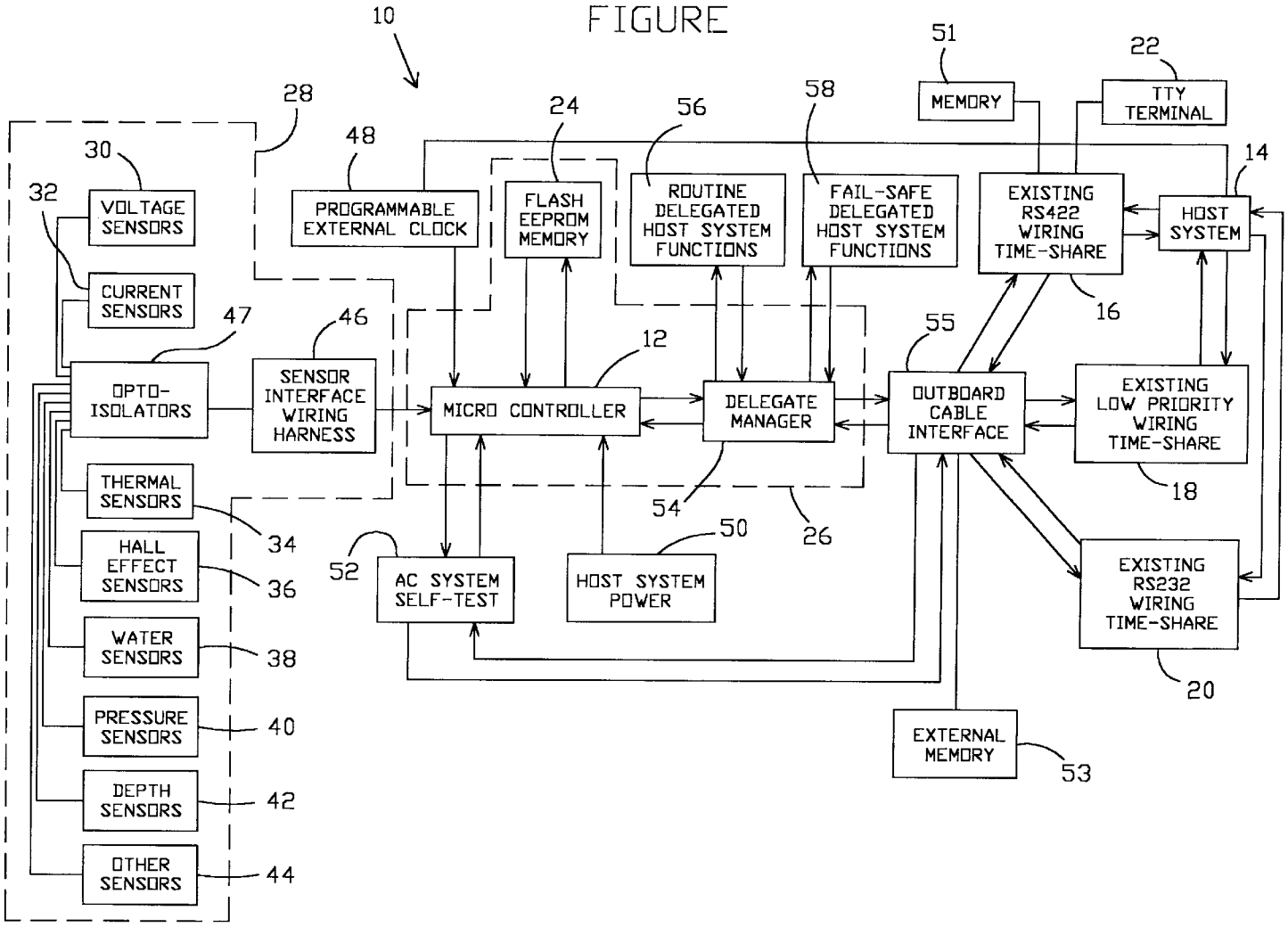
FIGURE

SUBMARINE MAST AUTONOMOUS CONTROLLER AND METHOD

STATEMENT OF THE GOVERNMENT INTEREST

The invention described herein may be manufactured and used by or for the Government of the United States of America for Governmental purposes without the payment of any royalties thereon or therefore.

CROSS REFERENCE TO OTHER PATENT APPLICATIONS

Not applicable.

BACKGROUND OF THE INVENTION (1) Field of the Invention

The present invention relates generally to systems and methods for performing generally nonsupervisory monitoring of conditions indicating faults or the onset of faults, collection of data valuable in decision making with regard to maintenance, and operation as built-in test equipment to aid in diagnostic and fail safe functions of the host system, in connection with a submarine mast. More particularly, the present invention provides an autonomous record keeping system that operates transparently to the host system and preferably shares mast communication lines and tasks to provide monitoring and diagnostics related to mast events of interest.

(2) Description of the Prior Art

It would be desirable to improve the reliability of submarine mast/antenna systems. For purposes described herein the submarine mast may comprise one or more moveable submarine masts, periscopes, antennas, and/or combinations thereof. Historically, volume within the submarine mast has been in such demand for functions critical to the submarine that there has been no room for any data collection devices. As well, significant concerns exist about electrical or electromagnetic interference that might arise from monitoring devices mounted within such tight spaces as the submarine mast volume that could possibly degrade performance of the duties of the submarine mast/antenna under certain conditions either by limiting real time processing abilities or by producing electrical interference.

Therefore, the presently utilized means to verify performance at sea in the prior art involves manual surveys and data input from maintenance/materials/management data reports. This method is labor intensive and has not proven adequate to detect problems early enough to avoid reactive, unexpected, and hence expensive responses. The data reports have been manually converted into a field reliability database via a suitable keyboard interface. The resulting time lag and variable quality of the information has significantly inhibited the potential effectiveness of this feedback procedure. Moreover, the data reports have not always provided sufficient and/or timely enough data to anticipate problems.

Various inventors have attempted to solve related problems as evidenced by the following patents.

U.S. Pat. No. 4,724,429, issued Feb. 9, 1988, to Millen et al., discloses a system for monitoring each of multiplicity of variables in the operation of a filter rod making machine that includes sensors located at various points on the machine. These sensors measure the value of such variable parameters as the width of the tow, the alignment of the wrapping paper, the speed of the rollers and the level of plasticizer. Each measured value is compared against preset limit values in a microprocessor. If a variable is detected to be outside a range of acceptable values, an indication of this fact is displayed on a monitor. In response to this indication, an operator can decide whether to override the limit value or take corrective action. If corrective action is to be taken, the microprocessor causes a diagnostic chart to be displayed. This chart provides the operator with a sequence of troubleshooting steps that can be taken to isolate the source of a possible problem and perhaps correct it before there is a need to arrest the operation of the machine.

U.S. Pat. No. 5,790,424, issued Aug. 4, 1998, to Sugihara et al., discloses a display method and a display unit wherein information which is required or often used by an operator is processed visually by enlarged display or colored display in accordance with historical data such as the past running conditions of the plant, the number of times of operations by an operator, the frequency of operations, and so on, and the processed information is displayed on the display unit. The use of historical data permits an operator to readily recognize which equipment is in most need of attention due to repeated problems in the past.

U.S. Pat. No. 5,831,540, issued Nov. 3, 1998, to Sullivan et al., discloses a system to determine the usage of loading dock equipment such as a dock leveler, a vehicle restraint and a barrier gate. The system provides an output indicative thereof. For each loading dock component mounted at a loading dock in an operable configuration whose operation is to be monitored, sensor outputs are used to provide data accumulated by PLC's located in a control panel associated with the loading dock. When operation of a piece of equipment is initiated the occurrence delivers an output signal to the PLC. A counting circuit accumulates a count of the output signals. The panel has displays in the form of lights and screens and the data may be read out by means of a hand held unit for display and/or programming or delivered to a remote PC by appropriate cable.

U.S. Pat. No. 6,133,841, issued Oct. 17, 2000, to U. L. Beckman, discloses a pole alarm system including an electromagnetic field sensor and collision sensors for detecting overhead power lines and physical obstructions within the intended path of a telescoping mast or utility boom device. The alarm system of the referenced patent includes a mast-mounted housing containing the sensors and a microprocessor-based control unit which interprets the output signals of the sensors and provides both audible and control feedback to a safety control module in the vehicle to alert the operator of impending contact and to automatically stop the movement of the mast. The alarm housing also features a light source which provides illumination in the direction of movement of the mast to assist in positioning thereof. The light source also functions as a heating element to prevent the accumulation of ice on the housing which would detrimentally affect the performance of the system. The alarm housing also includes a plurality of tilt sensors which monitor the orientation of the mast to prevent mast extension if the device deviates from an acceptable range of operation. A system integrated safety control module mounted in the vehicle provides self-test functions and an error code display to alert the operator to the cause of an alarm signal.

U.S. Pat. No. 6,157,310, issued Dec. 5, 2000, to Milne et al., discloses a monitoring system for monitoring operation of dynamic plant apparatus. Electronic processing means is provided for processing the electrical parameter signals provided by sensors and is capable of thereby producing a plurality of different fault signals. Display means is provided for displaying fault information to a user of the monitoring system, the display means being controlled by the fault signals produced by the electronic processing means. The electronic processing means compares the values of at least some of the measured parameter signals with limit values stored in memory by the electronic processing means and when the comparison shows that the value of a measured parameter signal is outside the respective limit value the electronic processing means produces a respective basic fault token signal. There are storage means with a plurality of different storage sites, each storage site having a plurality of storage locations for a different predetermined variety of basic fault token signals. When all storage locations of a storage site are filled by basic fault token signals then the electronic processing means produces a high level fault signal, causing the display means to display a fault message.

However, there remains a long felt but unsolved need for improved monitoring of submarine mast events that can be made without degrading operational abilities and/or increasing the cost of existing submarine mast functions. Those skilled in the art will appreciate the present invention that addresses the above and other problems.

SUMMARY OF THE INVENTION

Accordingly, it is an objective of the present invention to provide an improved mast monitoring system and method.

Another objective is to provide a system and method as aforesaid which provides a system and method that is transparent to the mast host system.

A further objective is to provide a system and method as aforesaid whereby a microcontroller is programmed to utilize existing mast communication lines on a time-sharing basis.

A still further objective is to provide a system and method as aforesaid whereby the sensors are electrically isolated from the mast host system.

Yet another objective is to provide a system and method as aforesaid which is capable of performing and/or being delegated to perform functions such as fail-safe functions and/or routine functions for the mast host system.

These and other objectives, features, and advantages of the present invention will become apparent from the drawings, the descriptions given herein, and the appended claims. However, it will be understood that above listed objectives and advantages of the invention are intended only as an aid in understanding aspects of the invention, are not intended to limit the invention in any way, and do not form a comprehensive list of objectives, features, and advantages.

In accordance with the present invention, a system is provided for monitoring events related to a submarine mast. The system may be comprised of a combination of various types of components such as, for instance, a microcontroller electrically interconnected to the host system such that the microcontroller is connected to the host system communication wiring, a plurality of sensors mounted to the submarine mast, a wiring harness for supplying data from the plurality of sensors to the microcontroller wherein the wiring harness may be electrically insulated with respect to the host system wiring to avoid electrical interference to the host system, and a microcontroller memory for the microcontroller to store the data from the plurality of sensors such that the microcontroller may be operable for automatically transferring the stored data from the microcontroller memory to a storage memory utilizing the host system wiring when the host system wiring is not being utilized by the host system.

The microcontroller memory may have sufficient storage capacity to store data for at least a significant portion of an overhaul cycle of the submarine mast, namely a plurality of months or for a plurality of years. The plurality of sensors mounted to the submarine mast may comprise suitably opto-isolated voltage sensors, current sensors, thermal sensors, other desired sensors which are opto-isolated and/or other sensors, whose operations are non-intrusive to the host system.

The system may further comprise a delegate module such that the host system is operable for delegating host system functions to the microcontroller. As well, the system may further comprise a teletypewriter (TTY) terminal interface to permit operation of the microcontroller through the TTY keyboard. The invention may also be practiced using any other known keyboard device to operate the microcontroller, such as a suitably programmed laptop computer.

In operation, a method for monitoring mast events of interest in a submarine mast is provided that may comprise one or more steps such as, for instance, (i) programming a microprocessor for operation independent of the host system, (ii) monitoring signals with the programmed microprocessor related to electrical current, electrical voltage, and temperature, (iii) storing monitor data related to the monitored signals with respect to time in a memory of the microprocessor, (iv) electrically connecting the microprocessor to one or more of the plurality of host communication lines on a time sharing basis whereby the microprocessor is operable for utilizing the one or more of the plurality of host communication lines when the host system is not utilizing the one or more of the plurality of host communication lines, and (v) dumping the monitor data stored in the memory of the microprocessor to another memory through the one or more of the plurality of host communication lines.

Other steps may comprise connecting a plurality of sensors to the microprocessor with a wiring harness that is electrically insulated with respect to the plurality of host system communication lines, programmably delegating selected host system functions to the microprocessor, and/or programmably delegating selected host system functions to the microprocessor in response to a failure of a selected mast component.

The method may further comprise utilizing an external clock for operating the microprocessor. The step of storing monitor data may further comprise storing the monitor data in a memory of the microprocessor of sufficient capacity to store information collected over at least a significant portion of the mast's overall cycle, namely, for over one or more months or years before performing the step of dumping. In one embodiment, the method may further comprise utilizing the host system for determining when to perform the step of dumping. Preferably, the method may further comprise utilizing the microprocessor to perform diagnostics on the submarine mast.

In another embodiment, a system is provided that may comprise a microcontroller electrically interconnected to the host system through the plurality of host system communication lines, a plurality of sensors mounted to the submarine mast, and a microcontroller memory for the microcontroller to store the data from the plurality of sensors and for storing programming for operating the microcontroller, the microcontroller being operable for automatically transferring the stored data from the microcontroller memory to a storage memory utilizing a respective one of the plurality of host system communication lines when the respective one of the plurality of host system communication lines is not utilized by the host system.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein corresponding reference characters indicate corresponding parts throughout several views of the drawings and wherein:

The FIGURE is a block diagram schematic showing a presently preferred configuration of a programmable submarine mast microcontroller system for monitoring mast events in accord with the present invention.

DESCRIPTION OF THE PREFERRED EMBODIMENTS

Referring now to FIG. 1, there is shown system 10 in accord with a presently preferred embodiment of the invention that provides a mast microcontroller system for monitoring mast events of interests. Microcontroller 12 may be programmed to perform desired functions without interfering with operation of mast host system 14. In a preferred embodiment, the present invention limits the need for running additional communications lines through the mast by selectively utilizing on a time sharing basis one or more existing communication lines which extend through the mast such as existing RS-422 wiring group 16, existing low priority wiring group 18, and/or existing RS-232 wiring group 20. As disclosed in more detail hereinafter, wiring groups 16, 18, and 20 generally carry the supervisory control signals of host system 14 to mast components. If faults occur, then real-time interactive diagnostic functions may be developed and operated via a TTY terminal 22, which may be connected to microcontroller 12 through a standard external interface such as, for instance, previously existing RS-422 wiring group 16 or other connections. Flash EEPROM memory 24 is programmable with suitable software that is preferably compatible for use on all fleet submarine communication masts as well as electronic warfare masts all periscopes. In a preferred embodiment, memory 24 provides sufficient storage capacity for long term storage which may preferably be at least sufficient to store information collected over a significant portion of the mast's overhaul cycle, namely, for months if not years. Thus, system 10 may operate transparently and independently of host system 14 for long periods of time, as desired.

Microcontroller 12, including its related connections, is quite small physically and therefore may be mounted in the limited space of suitable shielded electrical junction box 26 for the submarine mast. Microcontroller 12 may be programmed to operate various opto-isolated sensors. Examples of such opto-isolated sensors include voltage sensors 30, current sensors 32, thermal sensors 34, Hall effect sensors 36 (which sense dynamic flux fields as may be present in many electrical actuators such as motors or otherwise produced), water/flood sensors 38, pressure sensors 40, depth sensors 42, and other sensors 44, that may be mounted in appropriate positions upon or within mast 28. Microcontroller 12 may also be programmed to monitor the various commands and/or data to and from mast host system 14 that is provided on existing wiring groups 16, 18, and 20. Each wiring group may comprise a plurality of communication lines.

In a preferred embodiment, a separate sensor interface and wiring harness 46 interconnects the sensors and microcontroller 12 whereby host system 14 is completely electrically isolated therefrom. However, if desired, existing wiring, such as existing wiring RS-422 16, RS-232 wiring 20, and/or existing low priority wiring 18 could also be utilized to interconnect between the sensors and microcontroller 12. However, such interconnections to existing wiring would preferably be made in a manner to reduce or eliminate interference. One manner of such connections would preferably utilize optical isolators to eliminate any need for electrical interconnection between the sensors and any common wiring. If desired, optical isolators 47 may also be utilized, or not, in connecting the sensors to enhance the isolation of separate wiring harness 46. In another embodiment, the sensors may connect directly to and utilize the data lines themselves to supply power to the sensors thereby reducing the need for additional power lines through mast 28. In yet another embodiment, microcontroller 12 may connect to the sensors through a one-wire interface.

In accord with a method of the present invention, microcontroller 12 remotely operates the sensors and records events of interest. For instance if programmed to do so, microcontroller 12 may detect a command from host system 14 to initiate a mast raise/lower cycle. Current sensors 32 and voltage sensors 30 may be utilized to measure various voltages and currents associated with motors and/or other selected mast components to effect such operation. The relative currents and voltages, or power data, so detected can be monitored and compared to determine if significant changes occur as compared to previous similar events, e.g., does the current, voltage, and temperature of the particular motor being monitored stay within the designed range of operation under all circumstances? Other related information may also be provided such as data depth sensors 42, external pressure sensors 40, and Hall effect sensors 36. Thus, the power data can be compared for operation based on depth, external pressure, and speed of movement as may be determined from Hall effect sensors 36 (which sense dynamic activity or motion of flux fields) or other suitable mechanical movement sensors. Temperatures of various components within the mast may be recorded utilizing thermal sensors 34 to determine normal operating temperatures and provide early detection of any potential problems. As patterns are determined by analyzing data, then software routines can be downloaded by microprocessor 12 and utilized to provide early maintenance warnings of possible impending problems thereby reducing maintenance costs. Microprocessor 12 may be utilized for remote control of multiple digital thermometers and multiple software clocks for association with one or more sensors. Microprocessor 12 can be programmed to record faults, alarms, BIT commands, operational function changes, mast-up events, and/or other data. The sensors may be utilized to operate software clocks programmed to operate by means of microprocessor 12 such that data is collected with respect to time from a timer or elapsed timer.

Microcontroller 12 may preferably use an internal clock 48 for such measurements to provide time/date information related to the mast events of interest. The multiple software clocks, if utilized, may be provided by suitable programming. If desired, external programmable clock 48, which may also operate in conjunction with host system 14, may be utilized instead of microcontroller 12 internal clock or to provide timing synchronization between host system 14 and microcontroller 12 internal clock. Data collected by microcontroller 12 may be recorded and/or transmitted or dumped to suitable data storage 51 through one or more of existing wiring groups 16, 18, or 20. For instance, microprocessor 12 may utilize existing wiring groups 16, 18, and 20 when such wiring is not being used to thereby provide periodic data dumps that are transparent to host system 14. Outboard cable interface 55 may also connect to submarine systems that provide suitable memory 53 and software and/or portable devices to thereby cooperate with microcontroller 12. Host system 14 may also be utilized to send commands to microcontroller 12 to control copying of data to ensure by that means that operational functions are not occurring during data transfer from microcontroller 12 to the desired receptor of monitored data. Moreover, microprocessor 12 may be operable for communicating with the Internet such as while the submarine is dockside to provide access to long term data that may be unclassified, if desired.

Microcontroller 12 may be operated on power received and conditioned, as needed, from host mast power 50. Microcontroller 12 may be initiated into operation or reset utilizing system self-test control 52 that may be connected to outboard cable interface 55. In one embodiment, microcontroller 12 may comprise twin microcontrollers whereby self-test control 52 may be utilized to permit either one to boot a replacement, establish hull identity, and transfer data. Outboard cable interface 55 may also connect to submarine systems that provide suitable memory and software and other sensor information to cooperate with microcontroller 12. If desired, microcontroller 12 can be programmed to handle a plurality of masts for multi-masted submarines.

In a presently preferred embodiment, microcontroller 12 also comprises delegate manager 54. Delegate manager 54 permits microcontroller 12 or other systems such as host system 14, to permit microcontroller 12 to take over sensing as may be desirable for lower priority status sensors. Such sensors could include other flood sensors or overheating sensors other than water sensor 38 and/or thermal sensors 34. Thus, microcontroller 12 can be utilized to assist host system 14 by handling routine delegated host functions 56 and/or fail-safe delegated functions 58, if desired.

Thus, the present invention provides for nonsupervisory monitoring through programmed microcontroller 12 of one or more submarine masts and periscopes utilizing a sensor system including a group of sensors such as voltage sensors 30, current sensors 32, thermal sensors 34, and so forth. Microcontroller 12 provides passive time keeping and monitoring of the sensors in a manner that is preferably clocked from host system 14, which controls prime mission functions. In a preferred embodiment, there are no electrical connections between the sensor system and host system 14 to avoid concerns about interference within the mast. Instead, the sensors may be used to drive software clocks resident in microcontroller 12. The clock data is periodically downloaded into a suitable memory. System 10 may be utilized to perform diagnostics by service technicians attempting to locate problems in the mast by employing the capabilities of TTY terminal 22 to interface the technicians with system 10. Employing the TTY terminal (or alternatively a laptop) capability to provide a diagnostic interface function is within the scope of skills of persons engaged in the art. The methodology of designing a suitable network of test signal generation units, selection of points in the system at which to inject the test signals under control of the microcontroller, and selection of points in the system at which system operation will be sensed under control of the microcontroller, is well known. The methodology of producing a diagnostic module of the microcontroller programs to implement desired diagnostic algorithms which will be initiated by technicians at the TTY terminal keyboard, with appropriate diagnostic message responses outputted on the TTY terminal printer (or alternatively initiating from a laptop keyboard with monitor messages appearing on the laptop's), is within the scope of skills of persons engaged in the art. One of the secondary functions of the invention is to provide a field reliability database and real-time access to the sensor array for use as supplemental built-in test equipment that may be used for mast diagnostics. By utilizing system 10 for each fleet submarine, a suitable database can be quickly built-up and maintained with data that may be updated as desired.

While microcontroller 12 is referred to herein, it will be understood for purposes of this application that microcontroller 12 may comprise a microprocessor, a programmable integrated circuit, a microcomputer, processor, or any suitably small programmable computer. It will be appreciated by those skilled in the art that the invention could be implemented for testing and/or operation using a suitable programmed general purpose computer or special purpose hardware, with program routines or logical circuit sets performing as processors. Such routines or logical circuit sets may also be referred to as processors or the like.

Therefore, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for monitoring events related to a submarine mast, said submarine mast comprising a host system for controlling operation of said submarine mast, said host system comprising host system communication wiring including a first plurality of communication lines which generally carry supervisory control signals of said host system to submarine mast components and which physically extend through said submarine mast, said system comprising:

a microcontroller electrically interconnected to said host system, said microcontroller being connected to said host system communication wiring;

a plurality of sensors mounted to said submarine mast;

a wiring harness for supplying data from said plurality of sensors to said microcontroller, said wiring harness being formed of a second plurality of communication lines separate from said first plurality of communication lines to thereby electrically isolate said host system from said data from said plurality of sensors and in turn avoid imparting electrical interference to said host system; and a microcontroller memory for said microcontroller to store said data from said plurality of sensors, said microcontroller being operable for automatically transferring said stored data from said microcontroller memory to a storage memory utilizing said host system wiring when said host system wiring is not being utilized by said host system.

2. The system of claim 1 wherein said microcontroller memory has sufficient storage capacity to store data collected over at least a significant portion of an overhaul cycle of the submarine mast.

3. The system of claim 1 wherein said plurality of sensors mounted to said submarine mast comprise voltage sensors, current sensors, and thermal sensors.

4. The system of claim 1 wherein said microcontroller is separately programmable from said host system.

5. The system of claim 4 further comprising a delegate module such that said host system is operable for delegating host system functions to said microcontroller.

6. The system of claim 1 further comprising a keyboard interface for said microcontroller to permit operation of said microcontroller through said keyboard interface.

7. The system of claim 6 wherein said keyboard interface is a teletypewriter (TTY) terminal.

8. The system of claim 1 wherein the outputs of said plurality of sensors are respectively coupled to the wiring harness through individual opto-electrical isolators.

9. A method for monitoring mast events of interest in a submarine mast, said submarine mast comprising a host system for controlling mast operation of said submarine mast, said host system comprising a plurality of host system communication lines including a first plurality of communication lines which generally carry supervisory control signals of the host system to submarine mast components and which physically extend through said submarine mast, said method comprising:

programming a microprocessor for operation independent of said host system;

monitoring signals with said programmed microprocessor related to electrical current, electrical voltage, and temperature;

storing monitor data derived from said monitored signals with respect to time in a memory of said microprocessor;

electrically connecting said microprocessor to one or more of said first plurality of host communication lines on a time sharing basis whereby said microprocessor is operable for utilizing said first plurality of communication lines when said host system is not utilizing them; and dumping said monitor data stored in said memory of said microprocessor to another memory through said one or more of said first plurality of communication lines.

10. The method of claim 9 further comprising:

communicating said sensed monitored events to the microprocessor through a communication channel separate from the first plurality of communication lines to thereby electrically isolate the host system from the sensed monitored events.

11. The method of claim 9 further comprising programmably delegating selected host system functions to said microprocessor.

12. The method of claim 9 further comprising programmably delegating selected host system functions to said microprocessor in response to a failure of a selected mast component.

13. The method of claim 9 wherein said step of storing monitor data further comprises storing said monitor data for a period of time which at least extends over a period of time which is a significant portion of an overhaul cycle of the submarine mast before said step of dumping.

14. The method of claim 9 further comprising utilizing said host system for determining when to perform said step of dumping.

15. The method of claim 9 further comprising utilizing said microprocessor to perform diagnostics on said submarine mast.

16. A system for monitoring events related to a submarine mast, said submarine mast comprising a host system for controlling operation of said submarine mast, said host system comprising host system communication wiring including a first plurality of communication lines which generally carry supervisory control signals of said host system to submarine mast components and which physically extend through said submarine mast, said system comprising:

a microcontroller electrically interconnected to said host system through said plurality of host system communication lines;

a plurality of sensors mounted to said submarine mast; and a first microcontroller memory operatively associated with said microcontroller to store said data from said plurality of sensors and for storing programming for operating said microcontroller, said microcontroller being operable for automatically transferring said stored data from said first microcontroller memory to a second storage memory utilizing a respective one of said first plurality of communication lines when said respective one of said first plurality of communication lines is not being utilized by said host system.

17. The system of claim 16 further comprising a wiring harness for supplying data from said plurality of sensors to said microcontroller, said wiring harness being electrically isolated with respect to said first plurality of communication lines to avoid imparting electrical interference to said host system.

18. The system of claim 16 wherein said first memory has sufficient storage capacity to store data for at least a significant portion of an overhaul cycle of the submarine mast.

19. The system of claim 16 wherein said plurality of sensors mounted to said submarine mast comprise voltage sensors, current sensors, and thermal sensors.

20. The system of claim 16 wherein said supervisory control signals include signals to control at least one submarine mast actuator of a type which generates a dynamic magnetic flux field in operation, said system further comprising:

said plurality of sensors including at least one Hall effect sensor to monitor events related to operation of said at least one submarine mast actuator.

21. The system of claim 17 further comprising said plurality of sensors being respectively connected to said wiring harness through individual opto-electrical isolators.

* * * * *